US005772523A

United States Patent [19]

Sheftic

[11] Patent Number: 5,772,523

[45] Date of Patent: Jun. 30, 1998

[54] GOLF TRAINING DEVICE

[76] Inventor: Ted Sheftic, 406-A Mill Rd., New Oxford, Pa. 17350

[21] Appl. No.: 833,039

[22] Filed: Apr. 3, 1997

[51] Int. Cl.[6] ..... A63B 69/36

[52] U.S. Cl. ..... 473/227; 473/238; 473/282; 473/276; 473/277

[58] Field of Search ..... 473/227, 223, 473/238, 282, 276, 277

[56] References Cited

U.S. PATENT DOCUMENTS

| | | | |
|---|---|---|---|
| 3,918,721 | 11/1975 | Trask | 473/227 X |
| 4,582,325 | 4/1986 | Yuhara | 273/186 A |
| 4,662,240 | 5/1987 | Grander | 273/183 B |
| 4,880,240 | 11/1989 | Lewis | 273/188 R |
| 5,152,533 | 10/1992 | Radakovich | 273/186.2 |
| 5,257,779 | 11/1993 | Dalbo | 273/29 A |
| 5,439,214 | 8/1995 | Dalbo | 273/29 A |
| 5,451,060 | 9/1995 | Dalbo | 273/189 R |
| 5,465,971 | 11/1995 | Tischler | 273/186.2 |
| 5,470,073 | 11/1995 | Vasquez | 273/187.2 |
| 5,478,083 | 12/1995 | Foster, II | 273/194 R |

FOREIGN PATENT DOCUMENTS

| | | | |
|---|---|---|---|
| 708502 | 4/1965 | Canada | 273/48 |
| 2030870 | 4/1980 | United Kingdom . | |
| 2250444 | 10/1992 | United Kingdom | A63B 69/36 |

*Primary Examiner*—George J. Marlo
*Attorney, Agent, or Firm*—Aquilino & Welsh

[57] ABSTRACT

A golf training device adapted for attachment to a golf club grip for training a golfer to pivot and maintain a solid leading arm is disclosed. The device includes a body contacting arm having a first end adapted for attachment to the golf club grip and a free second end which contacts the body of a golfer when the golfer fails to pivot or maintain a solid leading arm as the golfer strikes a golf ball. The body contacting arm is shaped to lie adjacent, but not touch, the front hip of a golfer when the body contacting arm is properly attached to the golf club grip and the golfer addresses the golf ball. In use, the second end of the body contacting arm moves adjacent, but does not contact, the front hip of the golfer when the golfer pivots and maintains a solid leading arm as the golfer strikes the golf ball. However, the second end of the body contacting arm contacts the golfer if the golfer fails to properly pivot or maintain a solid leading arm as the golfer strikes the golf ball.

11 Claims, 3 Drawing Sheets

GOLF TRAINING DEVICE

BACKGROUND OF THE INVENTION

1. Field of the Invention

The invention relates to a golf training device. More particularly, the invention relates to a golf training device which trains golfers to rotate their hips and shoulders, while maintaining a solid leading arm at impact.

2. Description of the Prior Art

A wide variety of golf training devices have been developed over the years to help golfers practice and hone their swings. Many of these devices are quite effective in helping golfers fine tune their swings to optimize their performance. One aspect of the golf swing, however, which prior training devices have not adequately addressed is the golfer's pivot as he or she strikes the golf ball.

Specifically, as a golfer moves to strike the golf ball, his or her leading arm should be solid (that is, it should be straight and fully extended), while the golfer's hips should pivot toward the direction of the shot to provide ideal extension in the golfer's leading arm. When a golfer properly coordinates the motion of his or her leading arm and the pivot of his or her hips, the ball is struck in a manner optimizing performance.

Prior devices have addressed the problems associated with pivoting a golfer's hips and maintaining a solid leading arm. However, the prior devices are cumbersome, expensive, and generally difficult to utilize. As a result, a need exists for a convenient and effective golf training device capable of helping golfers to properly swing through the impact area by properly pivoting and maintaining a solid leading arm.

SUMMARY OF THE INVENTION

It is, therefore, an object of the present invention to provide a golf training device adapted for attachment to a golf club grip for training a golfer to pivot while maintaining a solid leading arm. The device includes a body contacting arm having a first end adapted for attachment to the golf club grip and a free second end which contacts the body of a golfer should the golfer fails to pivot or maintain a solid leading arm as the golfer strikes a golf ball. The body contacting arm is shaped to lie adjacent, but not touch, the front hip of a golfer when the body contacting arm is properly attached to the golf club grip and the golfer addresses the golf ball. In use, the second end of the body contacting arm moves adjacent, but does not contact, the front hip of the golfer when the golfer pivots and maintains a solid leading arm as he or she strikes the golf ball. However, the second end of the body contacting arm contacts the golfer if the golfer fails to properly pivot or maintain a solid leading arm as he or she strikes the golf ball.

It is also an object of the present invention to provide a golf training device wherein the first end of the body contacting arm includes means for securing the body contacting arm to the butt end of the golf club grip.

It is another object of the present invention to provide a golf training device wherein the means for securing includes a coupling member shaped to fit over the butt end of the golf club grip.

It is a further object of the present invention to provide a golf training device wherein the body contacting arm includes a first section adjacent the first end of the body contacting arm, a second section extending from the first section, and a third section adjacent the second end of the body contacting arm and extending from the second section.

It is also an object of the present invention to provide a golf training device wherein the first section and the second section are angularly offset, and the second section and the third section are angularly offset.

It is another object of the present invention to provide a golf training device wherein the body contacting arm is made of polyvinylchloride.

It is a further object of the present invention to provide a golf training device wherein the second section includes a stabilizing member.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
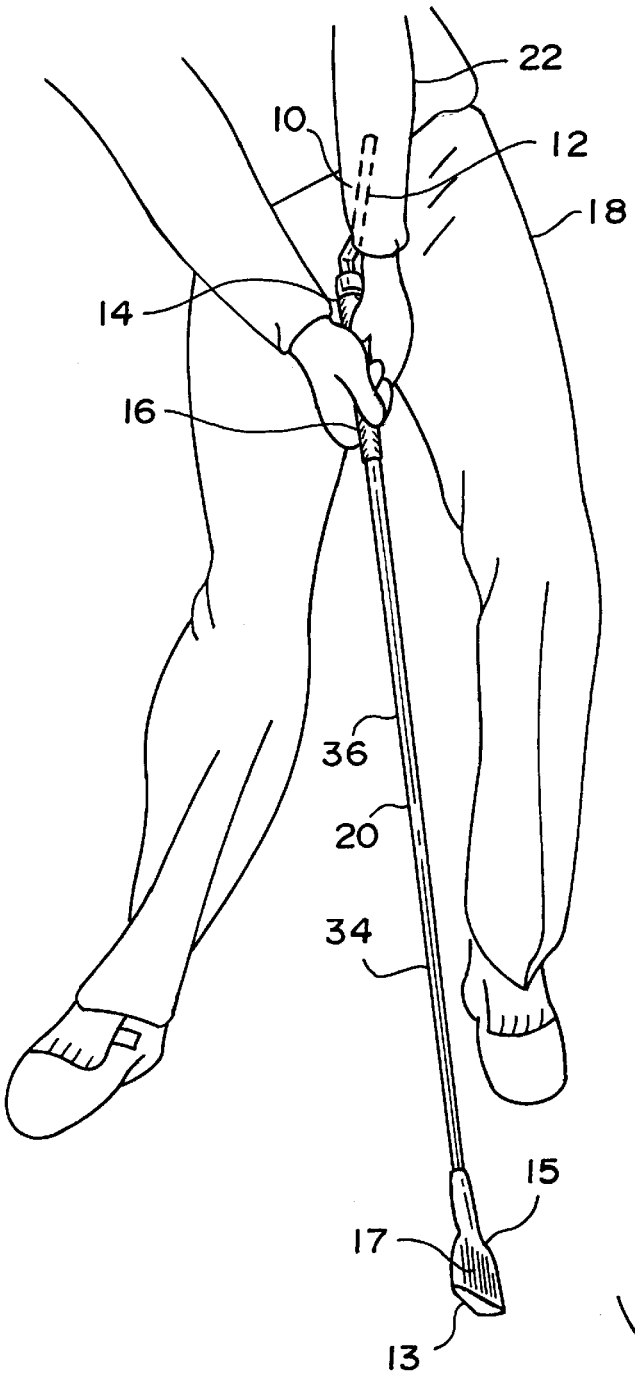
FIG. 1 is a perspective view of a golfer using the present golf training device.
Figure 2:
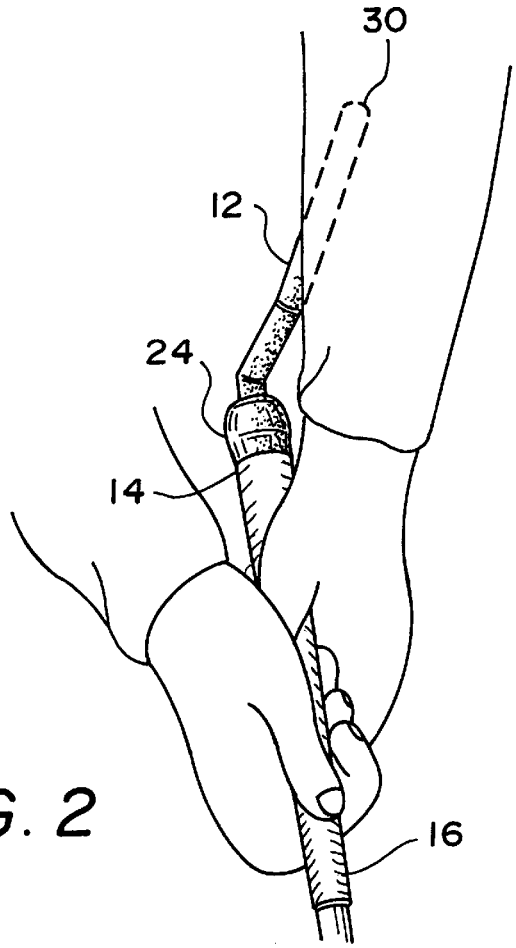
FIG. 2 is a close-up view of a golfer using the present golf training device.

With reference to FIGS. 1 and 2, the present golf training device 10 is disclosed. The golf training device 10 includes a substantially cylindrical body contacting arm 12 that is releasably coupled to the butt end 14 of a golf club grip 16. The body contacting arm 12 is shaped to lie adjacent, but not touch, the front hip 18 of a golfer when the body contacting arm 12 is properly attached to the grip 16 of a golf club 20 and the golfer addresses the golf ball. In use, the body contacting arm 12 moves adjacent, but does not contact, the front hip 18 of the golfer when the golfer pivots and maintains a solid leading arm 22 at impact. If, however, the golfer fails to properly pivot or maintain a solid leading arm at impact, the body contacting arm 12 will contact the golfer adjacent the golfer's leading hip 18.

With this in mind, the body contacting arm 12 includes a first end 24 with a coupling member 26 shaped to be received on the butt end 14 of the golf club grip 16. The coupling member 26 on the first end 24 of the body contacting arm 12 is cylindrically shaped and includes an open end 28. The open end 28 of the coupling member 26 is approximately the same size as the butt end 14 of the golf club grip 16 to permit the coupling member 26 of the body contacting arm 12 to snugly fit on the butt end 14 of the golf club grip 16. The secure attachment of the first end 24 of the body contacting arm 12 to the butt end 14 of the golf club grip 16 can be ensured by wrapping tape about the coupling member 26 of the body contacting arm 12 and the golf handle grip 16 adjacent the first end 24 of the body contacting arm 12.

The body contacting arm is also provided with a second end 30 shaped to contact the body of a golfer when the golfer fails to pivot or maintain a solid leading arm 22. As stated above, the shape of the body contacting arm 12 as it extends between its first end 24 and its second end 30 permits the second end 30 of the body contacting arm 12 to lie adjacent, but not touch, the front hip 18 of a golfer when the body contacting arm 12 is properly attached to the golf club grip 16 and the golfer addresses the golf ball.

Figure 3:
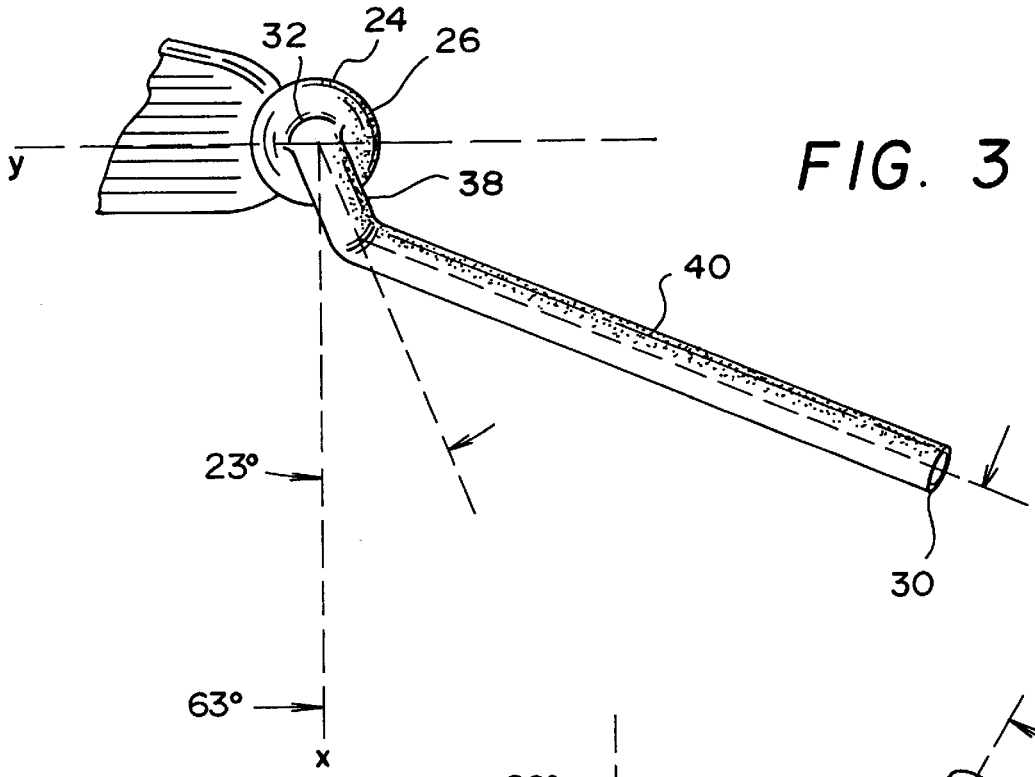
FIG. 3 is a top view of the present golf training device looking down the shaft of the golf club.
Figure 4:
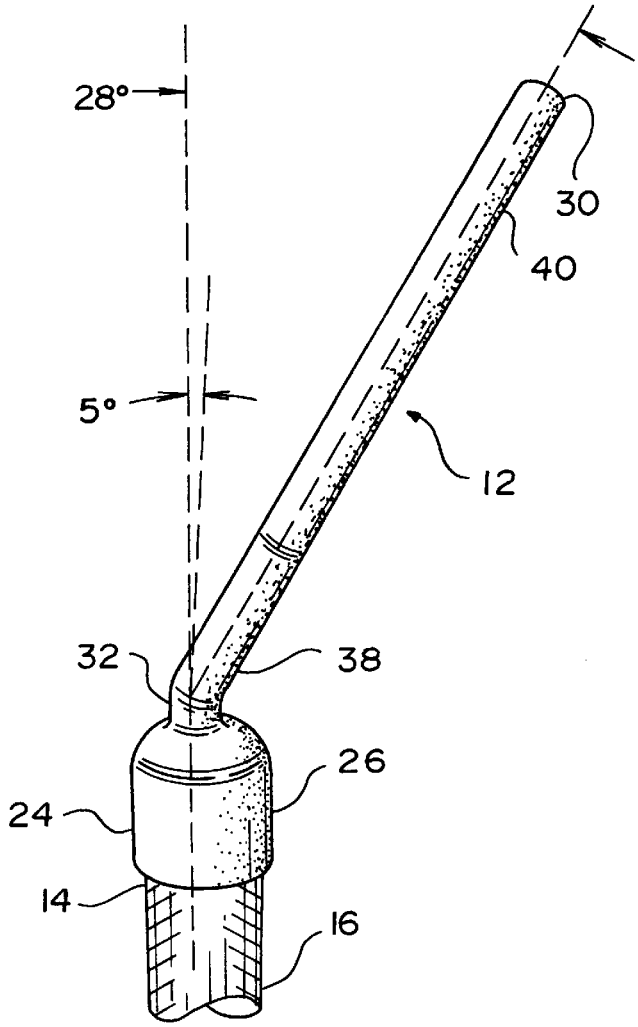
FIG. 4 is a plan view of the front of the present golf training device as viewed from the toe 13 of the golf club head 15.
Figure 5:
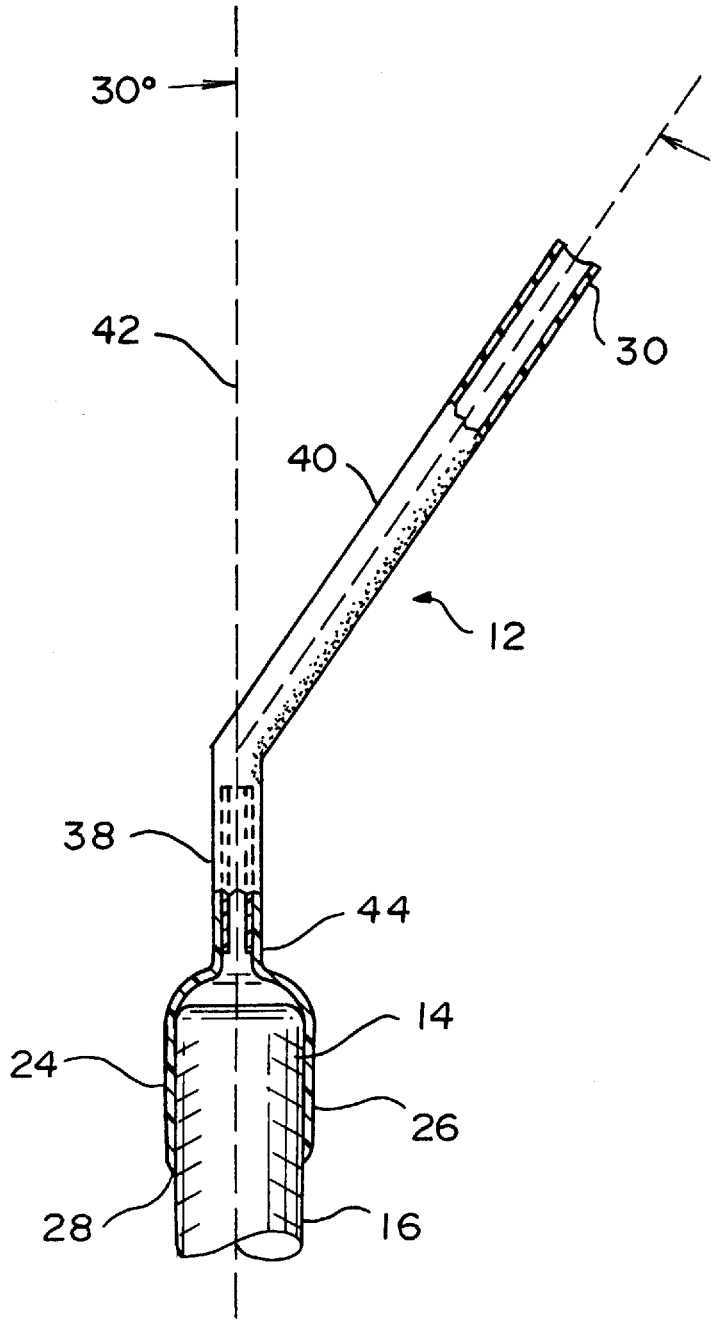
FIG. 5 is a partial cross sectional view of the present golf training device as viewed while looking toward the face 17 of the golf club head 15.

As such the body contacting arm 12 is provided with a first section 32 adjacent the first end 24 of the body contacting arm 12. The first section 32 extends substantially along a longitudinal axis 34 of the golf club shaft 36. A second section 38 extends from the first section 32. As shown in FIGS. 3 through 5, the second section 38 is bent such that it extends toward a golfer's body when the golfer grips the golf club 20 and properly addresses a golf ball. A third section 40 extends from the second section 38 and leads to the second end 30 of the body contacting arm 12. The third section 40 also extends toward the body of the golfer when the golfer grips the golf club 20 and properly addresses a golf ball. The first section 32, second section 38 and third section 40 are oriented such that the second end 30 of the body contacting arm 12 extends toward the body of the golfer without interfering with the golfer's swing. With this in mind, the body contacting arm 12 may take a variety of shapes without departing from the spirit of the present invention.

In accordance with the preferred embodiment of the present invention, if we look at FIGS. 3 and 4 as respectively defining the body contacting arm within the X-Y plane and X-Z plane, the body contacting arm 12 defines a specific path as it moves from the first section 32 to the second section 38, and finally to the third section 40. With reference to FIG. 3, the first section 32 substantially lies within the X-Z plane, while the second section 38 is set at an angle of 23 degrees from the X-Z plane and the third section 40 is set an angle of 63 degrees from the X-Z plane. With reference to FIG. 4, the first section 32 is set at an angle of 5 degrees from the Y-Z plane, the second section 38 is set an angle of 28 degrees from the Y-Z plane, and the third section 40 is set an angle of 28 degrees from the Y-Z plane. Finally, with reference to FIG. 5, the third section 40 is at an angle of 30 degrees relative to the longitudinal axis 42 of the second section 38.

To provide a body contacting arm 12 shaped to lie adjacent a golfer's body, it is preferred that the opening end 28 at the first end 24 is approximately 2 inches, the first section 32 is approximately ½ inch, the second section 38 is approximately 2 inches, and the third section 40 is approximately 6¼ inches. It should be understood that the dimensions and angular orientations disclosed above are merely considered to be exemplary, and the body contacting arm could take a variety of shapes and dimensions without departing from the spirit of the present invention.

The body contacting arm 12 is preferably constructed from flexible polyvinylchloride (PVC), although other materials could be employed without departing from the spirit of the present invention. PVC provides a material which is substantially rigid, but will flex when the body contacting arm of the present invention comes into contact with the body of a golfer. The stability of the body contacting arm is enhanced by the provision of a stabilizing member 44 within the second section 38 of the body contacting arm 12. The stabilizing member 44 is preferably a steel tube shaped to fit within the PVC tubing making up the body contacting member.

The combination of the first section 32, second section 38 and third section 40 create a body contacting arm 12 which lies adjacent, but does not touch, the front hip 18 of a golfer when the body contacting arm 12 is properly attached to the butt end 14 of the golf club grip 16 and the golfer addresses the golf ball. In use, the second end 30 of the body contacting arm 12 moves adjacent, but does not contact, the front hip 18 of the golfer when the golfer pivots and maintains a solid leading 22 arm as he or she strikes the golf ball. However, the second end 30 of the body contacting arm 12 contacts the golfer if the golfer fails to properly pivot or maintain a solid leading arm 22 as he or she strikes the golf ball.

Specifically, when the present golf training device is employed, the golfer swings in a conventional manner (when the device is initially employed it may be desirable to practice with a three quarter, or half swing, while the golfer becomes accustomed to the training device). As the golfer reaches the position where he or she is about to make contact with the golf ball, the golfer's hips should begin to pivot toward the target while the golfer's leading arm (in the case of the right handed golfer, the golfer's left arm) remains solid. That is, the golfer's leading arm should be straight and fully extended when he or she makes contact with the golf ball. As the golfer completes his or her swing and moves through the golf ball, the golfer's arm and shoulders should follow the pivot of his or her hips to provide a complete turn through the golf ball.

When a golfer swings though the golf ball in the manner described above, the second end of the body contacting arm will move adjacent, but not contact, the front hip of the golfer. However, when the golfer improperly swings through the golf ball, that is, the pivot is improper, and/or the leading arm is not solid, or the follow through is not complete, the second end of the body contacting arm will contact the golfer's body adjacent his or her hip. This will be an indication to the golfer that some portion of his or her swing was improper as the swing moved through the contact area.

While the preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A golf training device adapted for training a golfer to pivot the legs, hips and body, and maintain a solid leading arm during the execution of a golf swing, comprising:

a cylindrical cap, having a longitudinal axis, for attachment to a golf club grip;

a first section adjacent to and axially aligned with said cylindrical cap and extending from said cap at a first angle relative to said longitudinal axis; a second section angularly offset and extending from said first section at a second angle relative to said longitudinal axis, said second section being longer than said first section; and a third section angularly offset and extending from said second section at a third angle relative to said longitudinal axis, said third section being longer than said second section and having a free end thereon;

whereby said device, when said cylindrical cap is properly attached to a golf club grip, moves adjacent, but does not contact, the front hip of the golfer when the golfer pivots and maintains a solid leading arm during the execution of a golf swing and said free end of the third section of said device contacts the golfer if the golfer fails to properly pivot or maintain a solid leading arm during the execution of a golf swing.

2. The golf training device according to claim 1, wherein said first, second and third sections are formed of a one piece tubular structure; said cap being integrally attached to said first section.

3. The golf training device according to claim 2, wherein the second section of said tubular structure includes a stabilizing member.

4. The golf training device according to claim 1, wherein said first section is offset from said longitudinal axis of said cylindrical cap attached to said golf club grip by an angle not exceeding 5 degrees.

5. The golf training device according to claim 4 wherein said second section is offset from said longitudinal axis of said cylindrical cap attached to said golf club grip by an angle not exceeding 23 degrees.

6. The golf training device according to claim 5 wherein said third section is offset from said longitudinal axis of said cylindrical cap attached to said golf club grip by an angle not exceeding 30 degrees.

7. The golf training device according to claim 6, wherein said second section includes a stabilizing member.

8. The golf training device according to claim 1 wherein said second section extends from said first section towards a golfer's body at an angle of 23 degrees with respect to an X-Z plane through said longitudinal axis and at an angle of approximately 30 degrees with respect to an Y-Z plane through said longitudinal axis towards a golfer's body.

9. The golf training device according to claim 8 wherein said third section extends from said second section towards a golfer's body at an angle of 63 degrees with respect to an X-Z plane through said longitudinal axis and an angle of 30 degrees with respect to an Y-Z plane through said longitudinal axis towards a golfer's body.

10. A golf training device adapted for training a golfer to pivot the legs, hips and body, and maintain a solid leading arm during the execution of a golf swing, comprising:

a cylindrical cap, having a longitudinal axis, for attachment to a golf club grip;

a first section adjacent to and axially aligned with said cylindrical cap and extending from said cap at a first angle relative to said longitudinal axis; a second section angularly offset and extending from said first section at a second angle relative to said longitudinal axis, said second section being longer than said first section; and a third section angularly offset and extending from said second section at a third angle relative to said longitudinal axis, said third section being longer than said second section and having a free end thereon; wherein said first, second and third sections are formed of a one piece tubular structure; said cap being integrally attached to said first section;

said first section being offset from said longitudinal axis of said cylindrical cap attached to said golf club grip by an angle not exceeding 5 degrees;

said second section being offset from said longitudinal axis of said cylindrical cap attached to said golf club grip by an angle not exceeding 23 degrees said third section being offset from said longitudinal axis of said cylindrical cap attached to said golf club grip by an angle not exceeding 30 degrees;

whereby said device, when said cylindrical cap is properly attached to a golf club grip, moves adjacent, but does not contact, the front hip of the golfer when the golfer pivots and maintains a solid leading arm during the execution of a golf swing and said free end of the third section of said device contacts the golfer if the golfer fails to properly pivot or maintain a solid leading arm during the execution of a golf swing.

11. The golf training device according to claim 10, wherein said second section includes a stabilizing member.

* * * * *